US006877230B2

(12) United States Patent
Tapia

(10) Patent No.: US 6,877,230 B2
(45) Date of Patent: Apr. 12, 2005

(54) METHOD AND APPARATUS FOR CUTTING HAIR

(76) Inventor: Chris Tapia, 123 Alabama St., Huntington Beach, CA (US) 92648

( * ) Notice: Subject to any disclaimer, the term of this patent is extended or adjusted under 35 U.S.C. 154(b) by 48 days.

(21) Appl. No.: 10/299,305

(22) Filed: Nov. 20, 2002

(65) Prior Publication Data

US 2003/0159296 A1 Aug. 28, 2003

Related U.S. Application Data

(63) Continuation-in-part of application No. 10/080,138, filed on Feb. 22, 2002, now Pat. No. 6,751,870.

(51) Int. Cl.[7] ..... B26B 13/00
(52) U.S. Cl. ..... 30/191; 30/254; 30/259
(58) Field of Search ..... 132/200, 213, 132/214; 30/41.9, 43, 173, 175, 186, 194, 253, 254, 344

(56) References Cited

U.S. PATENT DOCUMENTS

| | | | | | |
|---|---|---|---|---|---|
| 34,368 | A | | 2/1862 | Hurd | |
| 176,553 | A | | 4/1876 | Schafer | |
| 362,817 | A | | 5/1887 | Carson | |
| 366,605 | A | * | 7/1887 | Pollard | 7/133 |
| 496,584 | A | | 5/1893 | Taft | |
| 914,842 | A | * | 3/1909 | Illis | 30/32 |
| 942,356 | A | | 12/1909 | Shelley | |
| 1,033,373 | A | * | 7/1912 | Barrett | 30/55 |
| 1,264,045 | A | * | 4/1918 | Fischer | 30/55 |
| 2,532,921 | A | * | 12/1950 | Kashian | 30/233.5 |
| 3,866,610 | A | | 2/1975 | Kletschka | 128/322 |
| 3,921,641 | A | | 11/1975 | Hulka | 128/321 |
| 5,153,997 | A | | 10/1992 | Chiavaras et al. | 30/257 |
| 5,628,115 | A | * | 5/1997 | Hebert | 30/262 |
| 6,019,021 | A | | 2/2000 | Keyvani | 81/416 |

* cited by examiner

*Primary Examiner*—Douglas D Watts
(74) *Attorney, Agent, or Firm*—Myers Dawes Andras & Sherman LLP

(57) ABSTRACT

An instrument for cutting hair comprises first and second members extending longitudinally in a direction generally perpendicular to a hinge axis of a hinge that connects the two members at proximal ends thereof. Each member has an arm and a leg. The legs have sockets in which blades are received. The arms comprise grip portions for grasping and actuating by a user's hand. During use, the actuation of the arms moves the legs in an arcuate path about the hinge axis similar to jaws on a pair of tongs. The instrument has a closed pinching or clamping position in which the blades meet each other in abutting relation. The method of using the instrument includes selecting blades from a group of tools comprising razor blades, thinning blades and backguards, disposing the selected blades in the sockets of respective legs, separating the legs, placing a lock of hair between the legs, clamping the blades on the lock of hair, and pulling or pushing the blades in a direction along the length of the hair to progressively cut hairs of the lock of hair.

8 Claims, 7 Drawing Sheets

FIG. 7A
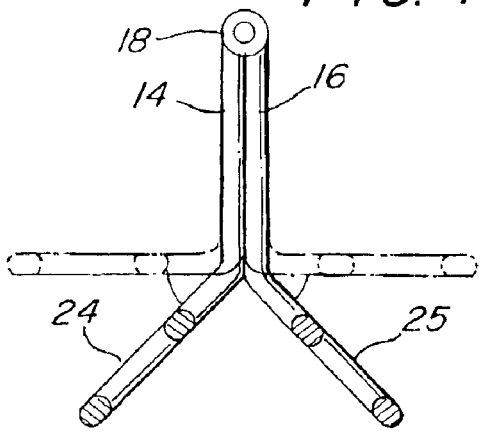
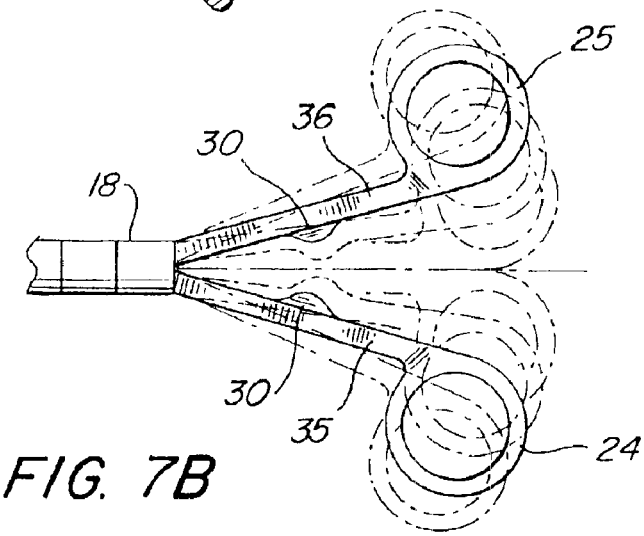
FIG. 7B
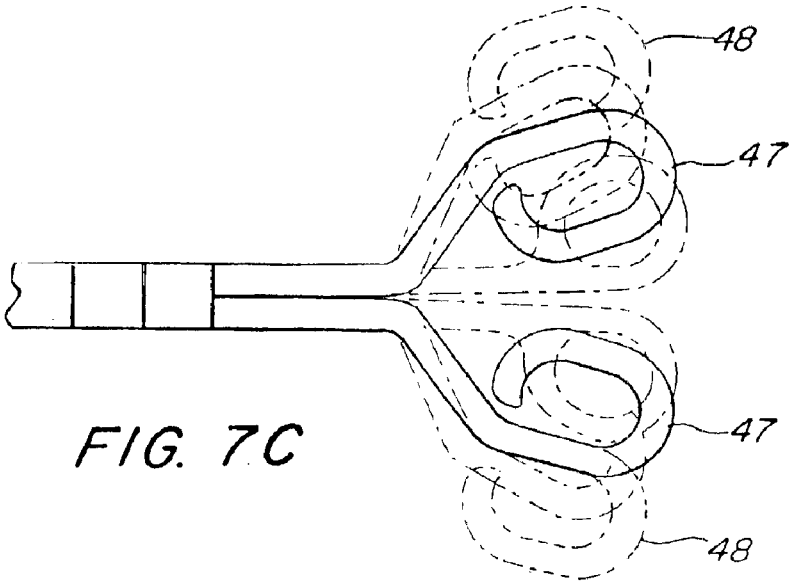
FIG. 7C

METHOD AND APPARATUS FOR CUTTING HAIR

This invention is a Continuation-in-part of U.S. patent application Ser. No. 10/080,138, filed Feb. 22, 2002 now U.S. Pat. No. 6,751,870 and entitled Haircutting Instrument and Method of Use.

BACKGROUND OF THE INVENTION

1. Field of the Invention

The invention relates to haircutting instruments and methods of using the same primarily in barber shops and beauty salons.

2. Description of the Related Art

It is well known to use a straight blade in cutting and thinning hair. In the past this has been accomplished by placing an instrument with a blade on one side of a lock of hair and the user's finger on the opposite side of the lock of hair. The user thus pinches or clamps the lock of hair between the blade and his or her finger. This procedure of pinching or clamping a lock of hair between the finger and a blade has the advantage of slicing the individual hairs at an acute angle which provides a softer feel at the hair ends and also inhibits the problem of the hair breaking. Another benefit of cutting the hair ends in this way is that it causes individual hairs to lie neatly within the lock of hair. However, this is a tedious operation and requires great skill to prevent cutting one's finger with the blade. The user must take care to avoid being cut while maintaining the proper amount of pressure and the proper angle of the blade with respect to the individual hairs in the lock of hair.

The present method for pinching and cutting does not assure the safety of the user or provide a consistency in the angle of cut. It fails to provide an instrument and a method for cutting hair with a straight blade, or any analogous tool that is easy to use. Still further, it fails to provide an instrument that has easily replaceable tools including blades, or alternatively, with an integral instrument and blades that are replaceable and disposable as a unit.

BRIEF SUMMARY OF THE INVENTION

The instant invention overcomes these deficiencies with an instrument that is easy to use, safe, and provides consistency in the angle of the cut.

In one embodiment, the instrument is comprised of two pieces or members that are coupled to each other by a hinge having an axis. Each member has an arm and a leg that are substantially parallel to each other and may be parallel to the axis of the hinge. Each arm has grip portions and each leg has a socket for receiving a tool, such as a razor blade. The legs and their associated tools are manipulated by the grip portions of the arms.

In use, the leg portions are initially separated by manipulating the grip portions. A lock of hair is placed between the tools that are positioned in the sockets of the legs. The legs are then clamped onto the lock of hair by a gripping action, and the instrument is pulled or pushed in a direction along the length of the lock of hair. This pulling or pushing action cuts individual hairs of the lock in a progressive manner as the instrument is moved along the lock.

The legs have jaws that are substantially parallel to each other. The jaws in a fully clamped position are spaced apart to enable a lock of hair to move between them. The jaws of the legs form the sockets which receive the tools. The tools comprise at least one cutting blade which can be a razor blade, a knife or a thinning tool. Tools also may include one backguard. Thus, the hair is clamped between two blades or a blade and a backguard so that when the instrument is pulled or pushed along the lock, the hairs of a lock of hair clamped between the jaws are pinched by the tools and progressively cut as the instrument is moved along the lock. Preferably, the edges of the tools that engage the lock of hair are parallel to each other so that the lock of hair receives even pressure along the length of the tools.

In one aspect of the invention, the arms and legs of each member of the instrument are spaced radially with respect to the axis of the hinge. In another aspect the arms and legs are generally parallel to the axis of the hinge. Expressed another way, each arm and each leg extends along a line parallel to the hinge axis. With this construction, the arms and legs remain generally parallel to each other and to the hinge axis during the hinging action.

The tools may be two razor blades which meet in a parallel relationship at their unsupported edges. Alternatively, the tools may be two thinning blades with multiple opposing tooth pairs. These teeth meet each other similarly to the two blades. However, with the thinning blades there are spaces between the teeth through which individual hairs may pass as the instrument is pulled or pushed away from the person's head. Thus, only some of the hairs are cut. Another alternative is to have one razor blade in the socket of one of the legs, and a backguard in the socket of the other leg. In this way the backguard and the razor blade meet in a pinching manner on the lock of hair. In practice, any combination of tools may be used in the instrument as long as one of the tools includes a cutting edge.

In another aspect of the invention, the instrument may be constructed such that the arms of the instrument are spaced at any preferred distance of comfort to the user. This spacing may be provided by the structure of the arms adjacent to the hinge wherein the arms abut each other and thereby space the finger loops from each other at a comfortable distance. Alternatively, stops may be provided at any location on the arms to mutually abut each other and provide the desired spacing.

As with a regular pair of scissors, the grip portions of the arms invention may be provided in the form of finger loops that are disposed generally in a common plane. However, it is contemplated that the grip portions may be angled to that regular plane by plus or minus 70 degrees about the hinge axis. The selection of these angles can be especially important because of the different manner in which this instrument is used as compared with regular scissors. That is, the forces required when pulling or pushing the instrument along the lock of hair are different from the forces required when using a regular pair of scissors. The forces required with the instant invention, in turn, affect the gripping requirements. Because of the gripping requirements of the instant invention, having finger loop angles different from those of regular scissor finger loops may be desirable in some cases.

In use, a lock of hair may be placed between the tools in the instrument legs and the legs may be clamped onto the lock of a hair with light pressure. Depending on the angle of the tools, little or no pressure may be required to continue the cutting action along the length of the lock of hair, cutting the hair is effected by pushing or pulling the instrument away from the person's head. The user may selectively apply more pressure to cut the individual hairs more rapidly or completely sever a lock of hair. Also a user may grasp the lock of hair between the instrument and the person's head to minimize pulling on the hair at the scalp during the use of the instrument.

In another aspect of the invention, the members are configured so that each respective jaw and arm is located on the same side of member relative to the hinge. Furthermore, the hinge may be arranged with its axis transverse to the length of the members. Specifically, the hinge may be located at proximal ends of the two members with the hinge axis perpendicular to the length of the members. A distal end may include the legs with jaws holding the tools. The arms may comprise grip portions and be located between the hinge and the legs. In this way, the instrument functions like a pair of tongs, and it can be appreciated that the members and the blade edges do not remain parallel to each other during pivoting action of the members on the hinge. However, the edges of the blades are brought into a generally parallel relationship relative to each other during the pinching action of the hair. This variation of the invention is otherwise similar to the previously described variations.

These and other features and advantages of the invention will become apparent with the following description of the preferred embodiments and reference to the associate drawings.

BRIEF DESCRIPTION OF THE DRAWINGS

FIG. 7A is a cross section view taken along lines VII—VII of FIG. 2;

FIG. 7B is a top plan view of the embodiment of FIG. 7A showing a finger loop configuration;

FIG. 7C is a top view similar to FIG. 7B showing an alternative embodiment of the finger loops;

DETAILED DESCRIPTION OF THE PREFERRED EMBODIMENTS

Figure 1:
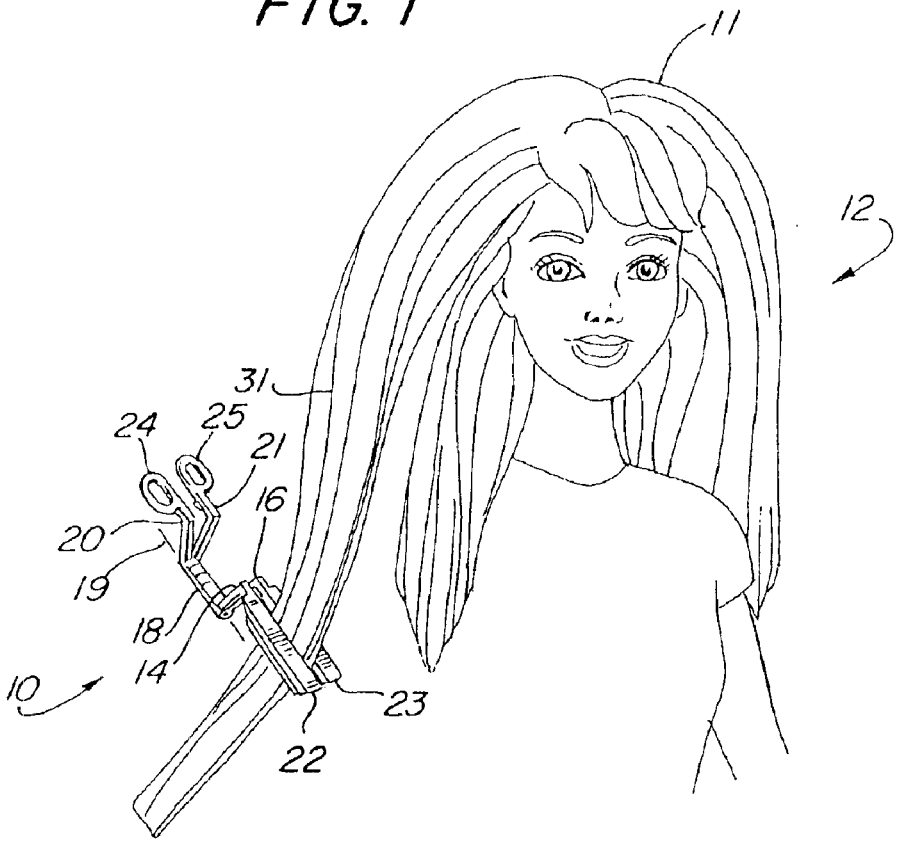
FIG. 1 is a perspective view of a first embodiment of the instrument being used to cut hair.

A haircutting instrument 10 useful in cutting the hair 11 of a person 12 is shown in the embodiment of FIG. 1. The haircutting instrument 10 has first and second members 14, 16 pivotally connected to each other by a hinge 18 having an axis 19. The members 14, 16 have respective arms 20, 21 and legs 22, 23, which are longitudinally separated by the hinge 18.

Figure 2:
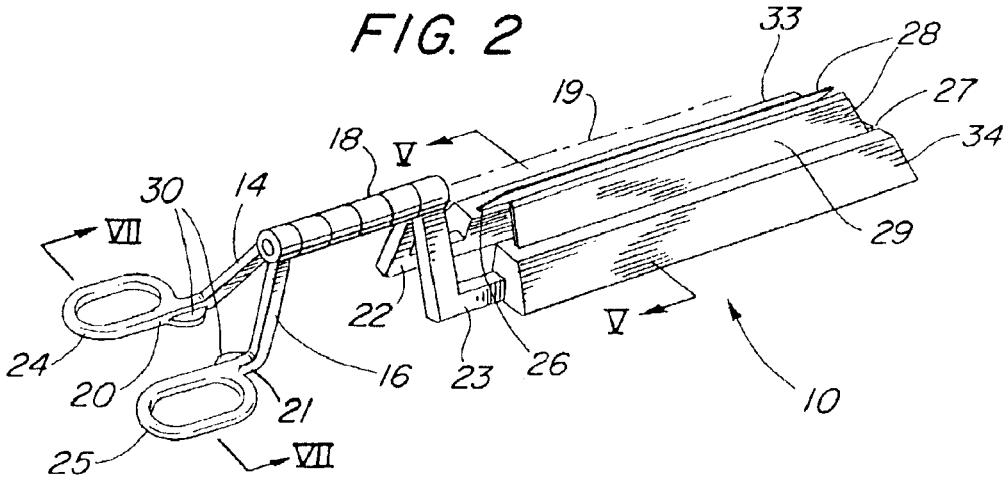
FIG. 2 is a perspective view of the instrument of FIG. 1.

As shown in FIG. 2, the hinge 18 in this case pivotally couples the first and second members 14, 16 together in a non-crossing configuration. Each of the two members 14, 16 is intended to remain on a common side of the hinge axis 19 during operation of the hinge 18. The arms 20, 21 have respective grip portions 24, 25 and the legs 22, 23 have respective sockets 27 for receiving a tool 28, such as a razor blade 29.

FIG. 2 shows an important aspect of the invention. This aspect is related to the orientation and position of the hinge 18. The hinge 18 has its axis 19 generally aligned with a length of the instrument 10. The important aspect shown in FIG. 2 is that the grip portions 24, 25 of the members 14, 16, respectively are offset from the hinge axis 19. The legs 22, 23 are also offset from the hinge access. The difference between the offsets of the grip portions 24, 25 and the legs 22, 23 determines the amount of mechanical advantage that is afforded to the user when using the instrument 10.

Another important aspect of the present invention is that the two members 14, 16 each extend lengthwise in a longitudinal direction. Each of legs 22, 23 and arms 20, 21 have straight features which extend lengthwise in the longitudinal direction. These straight features are generally parallel to each other and to the hinge axis 19 so that they remain parallel to each other and parallel to the hinge axis 19 during the operation of the hinge 18. As such, these straight features comprise pairs of straight features on respective members 14, 16. These pairs of straight features are disposed to sweep out respective circumferential arcs of common circles that are concentric with the hinge axis 19.

As best illustrated in FIGS. 1–2 and 7, the arms 20, 21 have the straight features referred to above provided by portions of the arms that extend in the same direction as the hinge axis 19 between generally radially extending portions of the arms 20, 21 and the grip portions 24, 25, respectively.

The figures show the first leg extending along a first line and the second leg extending along a second line. These lines are clearly parallel to each other. The embodiment of FIGS. 1 and 2 has arms 20, 21 with generally straight features extending in the same directions as the first and second lines. In fact, the straight features of the first and second arms 20, 21 may extend along the first and second lines defined by the first and second legs 22, 23. Alternatively, they may be offset from the first and second lines. In either case, the first and second lines are spaced from a third line defined by the hinge axis 19 of hinge 18.

It can be seen from FIG. 2 that the portions of the arms 20, 21 that extend radially away from the hinge axis 19 may serve as stops to define one end of the range of motion of the members 14, 16 with respect to each other. In this case, no additional structure is required. Alternatively, stops 30 may be provided in order to determine an end of a range of motion of the members 14, 16 relative to the each other in a closed, pinching or clamping configuration. It can be seen that in the pinching or clamping configuration that legs 22, 23 remain spaced apart such that a lock of hair 31 is permitted to slide between legs 22, 23. On the other hand, tools 28 abut each other and will pinch and cut individual hairs 32 of the lock of hair 31 when the instrument 10 is clamped thereon and pulled in a direction along the length of the lock of hair 31.

Figure 3:
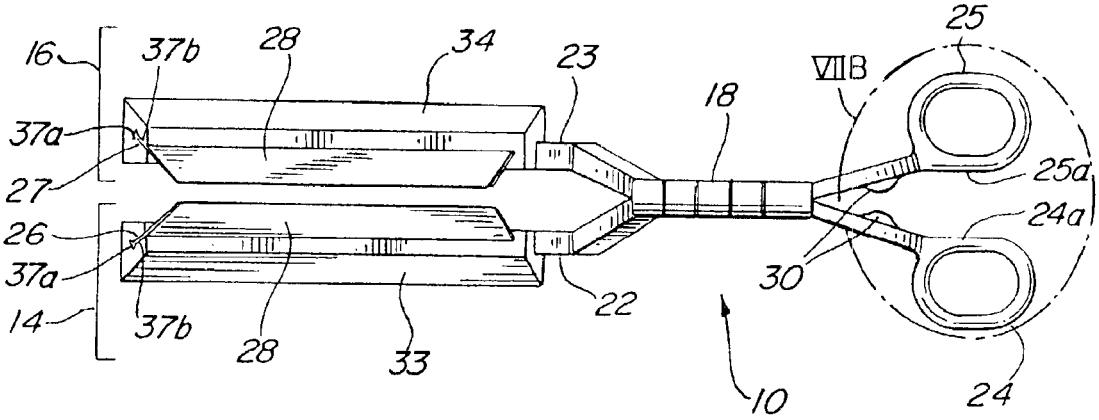
FIG. 3 is a top plan view of the instrument of FIG. 2.

FIG. 3 clearly shows that the tools 28 not only approach each other in pinching or clamping configuration, but that they also approach each other in a parallel relationship. The legs 22, 23 also have respective jaws 33, 34 that remain parallel to each other during operation of the hinge 18. When the jaws 33, 34 approach each other toward a clamping configuration, the opposing tools 28 eventually meet each other in parallel abutting relationship. This permits the lock of hair 31 to be pinched or clamped between the tools 28 for cutting action.

Figure 4:
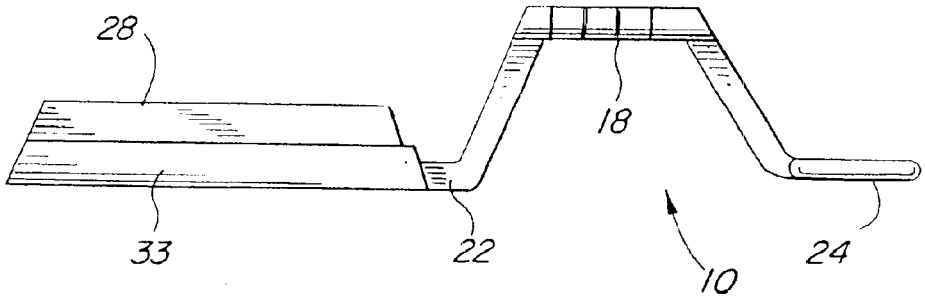
FIG. 4 is a side elevation view of the instrument of FIG. 2.

The embodiment of FIGS. 3 and 4 is substantially similar to the embodiment of FIGS. 1 and 2 with the exception of the arms. FIGS. 3 and 4 have substantially no axially extending portion on their alternative arms 35, 36 between the radially extending portions and the grip portions. However, segments 24*a*, 25*a* of the grip portions of the alternative arms 35, 36 extend along lines parallel to or aligned with the lines defined by the straight features of the legs 22, 23. Furthermore, segments 24*a*, 25*a* of the grip portions 24, 25 extending along lines parallel to or aligned with lines defined by the straight features of the legs can be considered as providing straight features themselves. Certainly, it is within the spirit and scope of the invention to construct these portions such that they have straight features.

FIG. 4 is a side view that further shows the offsets of the grip portions 24, 25 and the legs 22, 23 from the hinge axis 19.

Figure 5A:
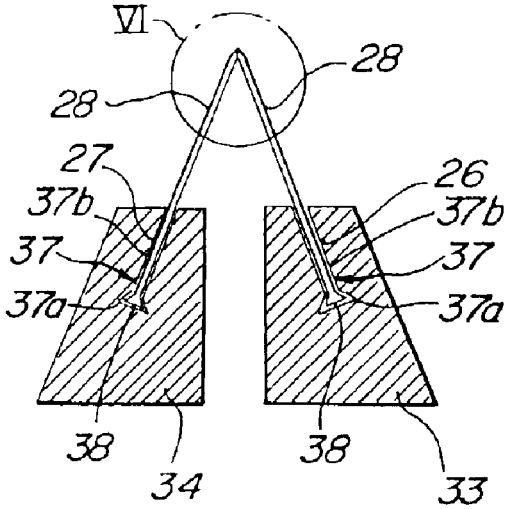
FIG. 5A is a cross section view taken along lines V—V of FIG. 2.

FIG. 5A is a section view taken along lines V—V of FIG. 2 and showing the jaws 33, 34 and their respective sockets 26, 27. The sockets 26, 27 may be of any configuration, but are illustrated in the form of grooves 37. Preferably the grooves 37 have an enlarged or reentrant base portion for receiving an enlarged portion 38 of the tool 28. The enlarged base portion of the grooves 37 and the enlarged portion 38 of the tool 28 may be of any shape or configuration as long as they mate when the tool 28 is in a respective groove 37. It is of particular interest to provide the enlarged portion 38 of the tool 28 larger than the non-enlarged portion of the groove 37 into which the tool 28 is inserted. In this way the tool 28 is prevented from leaving the groove in a generally radial direction along the groove. The directions that the tools 28 may be inserted and removed from the sockets 26, 27 are axial directions.

The tools 28 that can be received in sockets 26, 27 are selected from the group comprising razor blades 29, knives, thinning tools 40, and backguards 41. FIG. 5B is a detailed top view of a cut away portion of tools similar to FIG. 3, showing thinning tool 40 with edges 42. These thinning tool edges 42 can be notched or comb shaped as illustrated in FIG. 5B.

Figure 5C:
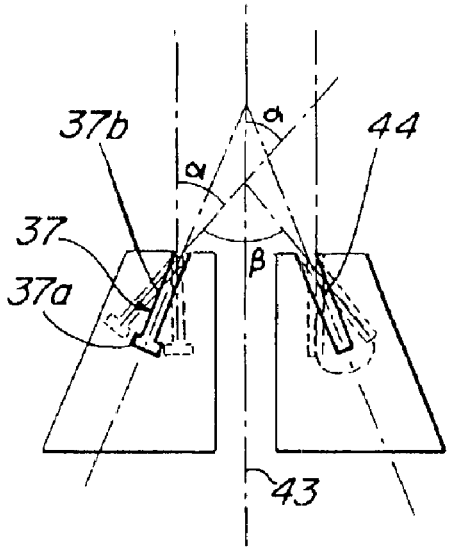
FIG. 5C is a cross section view similar to FIG. 5A showing the range of angles at which the sockets can be disposed.
Figure 5B:
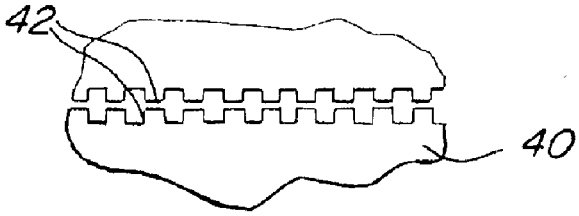
FIG. 5B is a detailed top view of a cut away portion of tools similar to FIG. 3 showing alternative tools edges.

FIG. 5C shows that the instrument 10 can be made to accommodate tools 28 which are oriented at an angle measured relative to a plane 43 bisecting the instrument 10. By way of example, this angle may be included within a range of 0 to 45 degrees when the instrument 10 is in a closed, pinching or clamping configuration. Expressed in another way, the instrument 10 can be constructed so that the angle between the tools 28 can vary in a range of 0 to 90 degrees. It should also be noted from FIG. 5C that the socket 45 may be of a modified form in order to receive a backguard 41, which will typically be formed of a rigid material such as plastic.

Figure 6A:
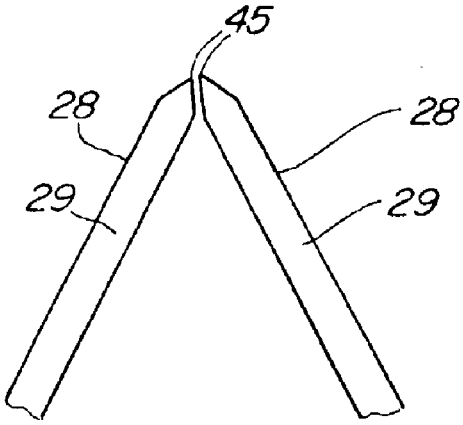
FIG. 6A is a detailed end view of section VI of FIG. 5A showing how the tools meet at unsupported edges.

FIG. 6A is a detailed end view of portion VI of FIG. 5A and shows how the tools 28 abut each other. As is shown, the unsupported edge 45 of each tool 28 meets a unsupported edge 45 of the other tool 28 in a mutually abutting relationship.

Figure 6B:
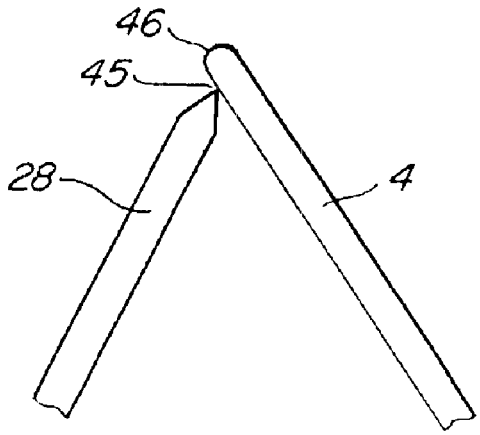
FIG. 6B is a detailed end view similar to FIG. 6A, but showing the razor blade and a backguard tool combination meeting at their unsupported edges.

FIG. 6B shows a detailed end view similar to FIG. 6A having the combination of a blade and a backguard 41 in respective jaws 33, 34. With this combination the tips of the tools 28 will typically meet at their edges 45, 46. The unsupported edge 46 of the backguard 41 should extend at least to a unsupported edge 45 of the razor blade 29 or beyond. Conceptually, the two razor blade configuration of FIG. 6A is similar to the configuration of FIG. 6B wherein one of the razor blades 29 in FIG. 6A serves as a backguard 41.

FIG. 7A is a sectional view taken along lines VII—VII of FIG. 2. This view emphasizes the possibility of selectively forming the arms 20, 21 in other than a planar configuration. Specifically, the arms 20, 21 may include grip portions 24, 25 or finger loops having grip portions 24, 25 defining planes at plus or minus 70 degrees from the flat plane defined by finger loops of a regular pair of scissors. Expressed another way, each of the finger loops may define a plane that is between 20 and 160 degrees relative to a bisecting plane that symmetrically bisects the two members 14, 16 of the instrument 10 when in its closed, pinching or clamping configuration.

FIG. 7B is a detailed view of the portion of FIG. 3 encircled by the line VIIb. FIG. 7B shows the selectively variable way in which the alternative arms 35, 36 may be configured. Specifically, the alternative arms 35, 36 may be formed to define any of a variety of angles therebetween in order to meet the needs of a variety of users. It is of particular interest to locate the grip portions 24, 25 at a distance that permits the user to apply a force with ease. Locating the grip portions 24, 25 at the right distance is important for hairdressers or barbers who spend long hours utilizing instruments that they must grip. FIGS. 3 and 7B also show a variation from the embodiment shown in FIG. 2 in that the additional stops 30 are located along the portions of the alternative arms 35, 36 that extend radially away from the hinge 18.

FIG. 7C shows an alternative embodiment of the grip portions 24, 25 in the form of finger loops 47, 48. As shown by the dashed lines in FIG. 7C the grip portions may be formed by finger loops 47 which extends inwardly or by finger loops 48 which extend outwardly from the remaining part of the arms. The finger loops 47, 48 may be selectively spaced similarly to the embodiment of FIG. 7B.

Figure 8A:
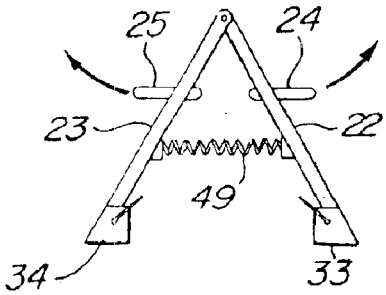
FIGS. 8A and 8B are end views showing alternative embodiments including tension and compression springs, respectively.
Figure 8B:
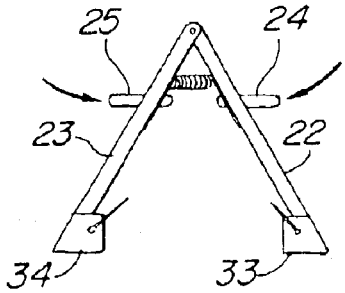

FIGS. 8A and 8B are end views of the instrument 10 showing alternate embodiments which include springs 49, 50, respectively. FIG. 8A shows a tension spring 49 that will hold the two members 14, 16 of the instrument 10 together in a clamping configuration. In this embodiment the user is required to force the jaws open by moving his or her fingers outwardly to expand the jaws against the bias of tension spring 49. FIG. 8B, on the other hand, illustrates a compression spring 50 that applies an outward force to the members 14, 16. In this embodiment, a user is required to force the members 14, 16 inwardly together by squeezing the grip portions 24, 25 against the bias of the spring 50.

Figure 8C:
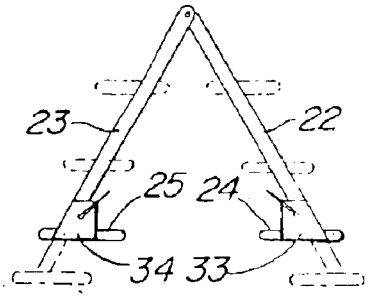
FIG. 8C is an end view showing alternative locations of finger loops at varying distances from the hinge axis.

FIG. 8C is an end view showing alternative locations of the grip portions 24, 25 in dashed lines. By selecting the distance of the grip portions 24, 25 from the axis 19 of the hinge 18, the mechanical advantage is determined. It can be seen that if the grip portions 24, 25 are further away from the hinge axis 19 than are the unsupported edges 45 of the tools 28, a relatively small force applied to the grip portions 24, 25 will result in a larger force at the unsupported edges 45 of the tools 28 for pinching and cutting the lock of hair 31.

Figure 9A:
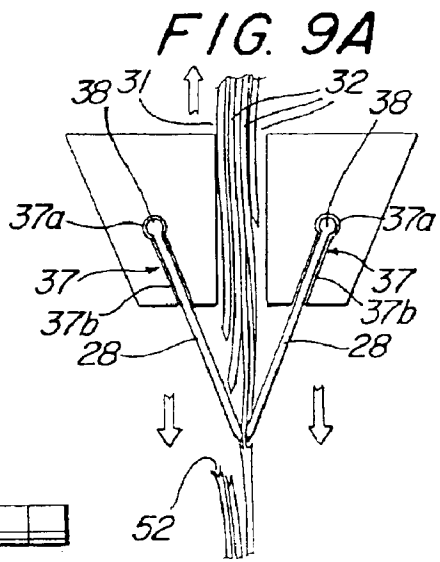
FIG. 9A is a cross section view similar to FIG. 5, but inverted to show the instrument in use.

FIG. 9A shows the effect of clamping the tools 28 on a lock of hair 31 and pulling the instrument 10 in the direction of the large arrows. As can be seen by the half-diamond shape 52 of the cut ends of the individual hairs 32 in FIG. 9A, both tools 28 act in a cutting function. By constructing the instrument so that the angles of the tools 28 are proper and by properly selecting blades having an angle of the taper of the cutting edges 45, cutting a lock of hair 31 actually causes a slight inward force on the tools 28 and in turn on the jaws 33, 34 of the instrument 10 such that little or no clamping force is required during the pulling or pushing force along the length of the lock of hair 31. Expressed in another way, when the tools 28 comprise two razor blades 29 with edges 45 having tapers which extend inwardly and away from the instrument 10, a plowing effect pushes the tools 28 and thus the jaws 33, 34 together when the instrument 10 is moved along the lock of hair 31 in a cutting action. The half-diamond shape 52 of the cut ends will only occur when a given individual hair 32 is cut by both blades. Most hairs 32 of a lock 31 will normally be protected on one side by other hairs 32 of the lock 31 and will only be cut by one blade.

Figure 9B:
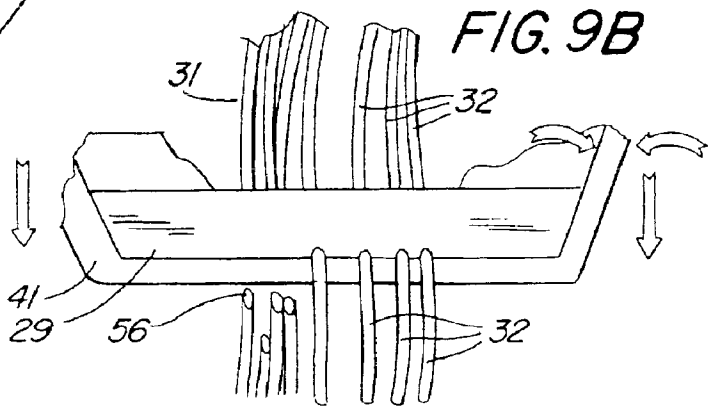
FIG. 9B is a side elevation view of the cutting process similar to that shown in FIG. 9A.

FIG. 9B shows a cutting action with the instrument 10 having a razor blade 29 for one of its tools 28 and a backguard 41 for the other of its tools 28. In this embodiment the individual hairs 32 are cut to have a single flat severed surface 56. Because of the angle of the razor blade 29 this single flat surface 58 forms an acute angle with respect to a lengthwise direction of the lock of hair 31 and the individual hairs 32 of the lock 31.

Figure 10:
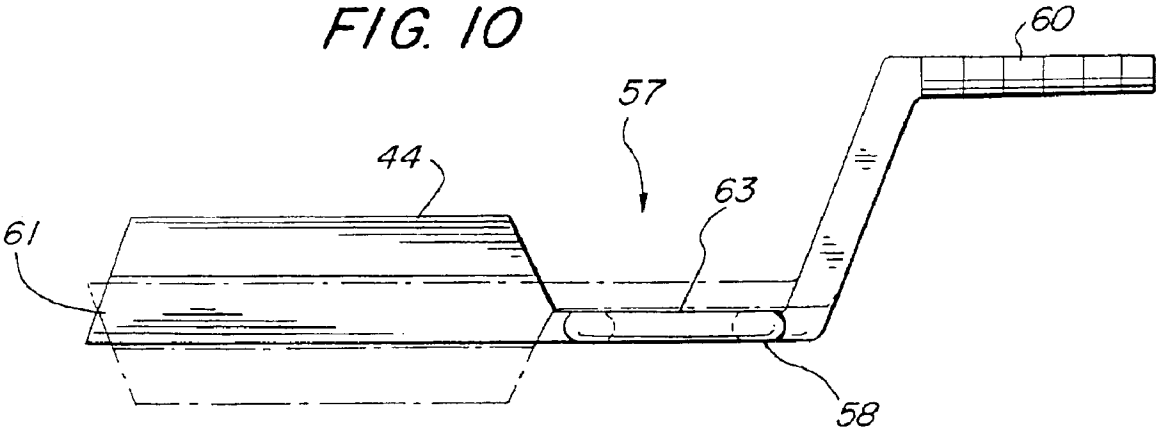
FIGS. 10 and 11 are side elevation views showing second and third alternative embodiments of the instrument of the present invention.

FIG. 10 is a second alternative embodiment showing a haircutting instrument 57 in which arms 58 have been relocated to a position between hinge 60 and legs 61. In this embodiment a user would position the hinge 60 in the palm of the hand or extending away from the palm of the hand with the fingers located in grip portions of the arms 58. As can be seen by the dashed lines, the sockets 26, 27 and the tools 28 may be oriented such that the unsupported cutting edges 45 of the tools 28 may point in the same direction as the hinge 60 or away from the hinge 60.

Figure 11:
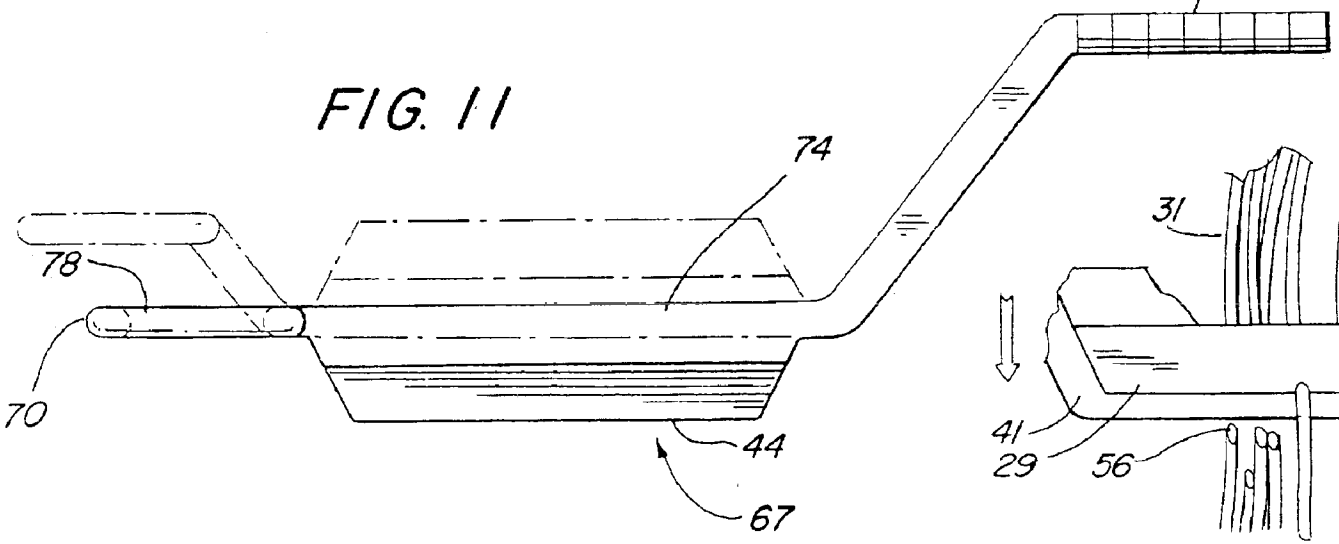

FIG. 11 is a third alternative embodiment showing a haircutting instrument 67 in which the arms 70 of the instrument 67 are located on an opposite end of the legs 74 from the hinge 76. In this embodiment it is contemplated that two hands would be used to pull or push the instrument 67 along the length of the lock of hair 31. As can be seen by the dashed lines, the arms 70 comprising grip portions 78 may be located at the same distance from the axis of the hinge 76 or alternatively may be placed at a location closer to the axis of the hinge 76. In this embodiment, similar to the embodiment of FIG. 10, the sockets 26, 27 and tools 28 can be made to face toward the axis of the hinge 76 or away from the axis of the hinge 76.

The method of using the haircutting instrument 10 of the instant invention is accomplished by a user cutting the hair 11 of the person 12. The method results in a tapered cut, or a thinned and tapered cut. In accordance with this method, the user separates the legs 22, 23 of the instrument 10 by moving the arms 20, 21 in a first direction. Then the user places a lock of hair 31 between the legs 22, 23. The user then clamps the legs 22, 23 on the lock of hair 31 by moving the arms 20, 21 in second direction. Then the user simultaneously maintains a clamping force on the lock of hair 31 and forces the instrument 10 in a direction generally perpendicular to the cutting edge 45. This action severs individual hairs 32 of the lock by a clamping and pulling action. This method requires the placement of the instrument 10 with the tools 28 oriented transverse to the lock of hair 31. Preferably the orientation of the instrument 10 is between 45 degrees and 135 degrees relative to the lock of hair 31. In the preferred embodiment a longitudinal axis 19 of the instrument 10 coincides with the longitudinal extension of the blade edges 45 on the tool 28. However it is contemplated that an instrument may be formed within the spirit and scope of this invention, which has an axis 19 which is longitudinal in a direction other than transverse to the blade edges 45.

Another aspect of the preferred embodiment is that in the method of using the instrument 10 an inward force on the jaws 33, 34 is maintained by virtue of the angle of the tapers on the blades disposed in the sockets 26, 27 in a clamping or pinching configuration. This inward force is caused by the shape of the blade tapers and the force of the instrument 10 moving in a direction along the length of the lock of hair 31, wherein a plowing effect is achieved which causes the inward force on the blades and thus on the jaws 23 of the instrument 10.

The method of using further comprises a preliminary step of selecting the tools 28 from a group of tools. The group of tools comprises a razor 29, a knife, a thinning tool 40 and a backguard 41. In the present invention the terms razor and knife are used interchangeably. However, it is understood that a knife generally has a thicker blade and often is not of the disposable type, which are more commonly termed razor blades. The preliminary step of selecting the tools 28 and fitting them in the sockets 26, 27 may comprise selectively choosing either two razor blades 29, a razor blade 29 and a backguard 41, two thinning blades, or a thinning blade and a backguard 41. Any combination of the tools 28 may be selected as long as one of the tools 28 selected has a blade for cutting hair 11.

While the method of using the haircutting instrument has been described relative to the embodiment of FIGS. 1–2 and 7, it should be well understood that the method of use will typically apply equally to all of the embodiments. Analogous parts are readily apparent from one embodiment to another in applying the method of use.

Figure 12:
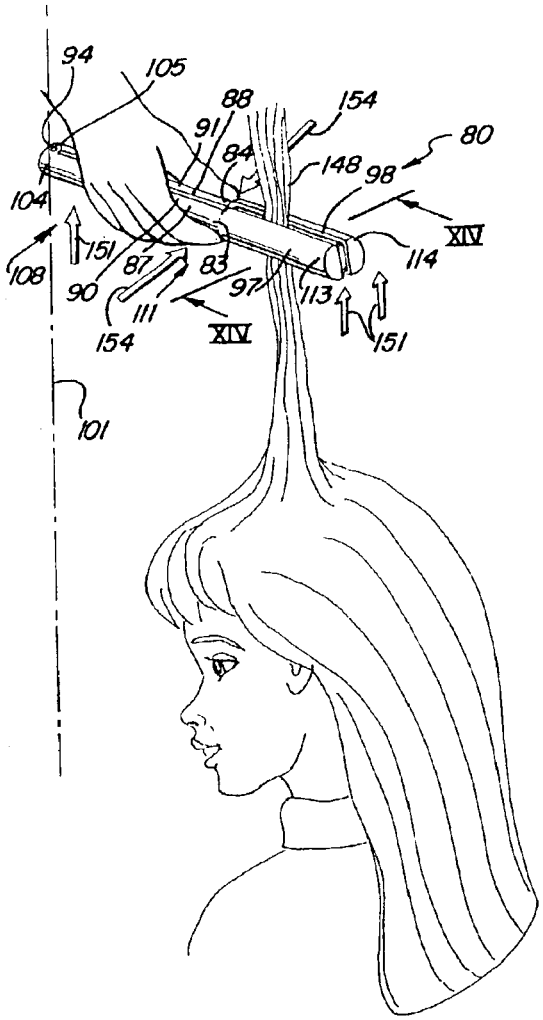
FIG. 12 is a perspective view of a fourth alternative embodiment of the invention being used to cut hair.

A fourth alternative embodiment illustrated in FIG. 12 is different from the first through the third embodiments. The first embodiment of the instrument 10 has the arms 20, 21 and the associated grip portions 24, 25 disposed on ends of the members 14, 16 that are opposite from the legs 22, 23. The first, second, and third embodiments illustrated in FIGS. 4, 10, and 11 have instruments 10, 51, 67 respectively. The instruments 10, 51, 67 have arms 20, 21 with grip portions 24, 25 and legs 22, 23 offset from the hinges 18, 60, 76. The fourth embodiment shown in FIG. 12 has an instrument 80 that is similar to the instrument 57 of the second alternative embodiment in that the members 83, 84 have arms 87, 88 and grip portions 90, 91 with the arms 87, 88 on the same longitudinal side of the hinge as the legs 97, 98. However, the grip portions 90, 91 do not have finger loops, and the hinge 94 is positioned with its axis 101 perpendicular to the longitudinal direction defined by the length of the members 83, 84.

The members 83, 84 comprise first and second longitudinal members 83, 84 having a pair of proximal ends 104, 105 pivotally connected together by the hinge 94. The arms 87, 88 comprise the proximal ends 104, 105 and portions of the members 83, 84 that extend from the proximal ends 104, 105 to the legs 97, 98. The arms 87, 88 are generally smaller than the legs 97, 98, and form a handle 108 including the grip portions 90, 91 on the respective members 83, 84.

The arms 87, 88 are connected to and support the legs 97, 98 at a respective pair of midsections 111, 112 of the members 83, 84. The legs 97, 98 extend from midsections 111, 112 of the members 83, 84 to the distal ends 113, 114 of the respective members 83, 84.

Figures 13, 15:
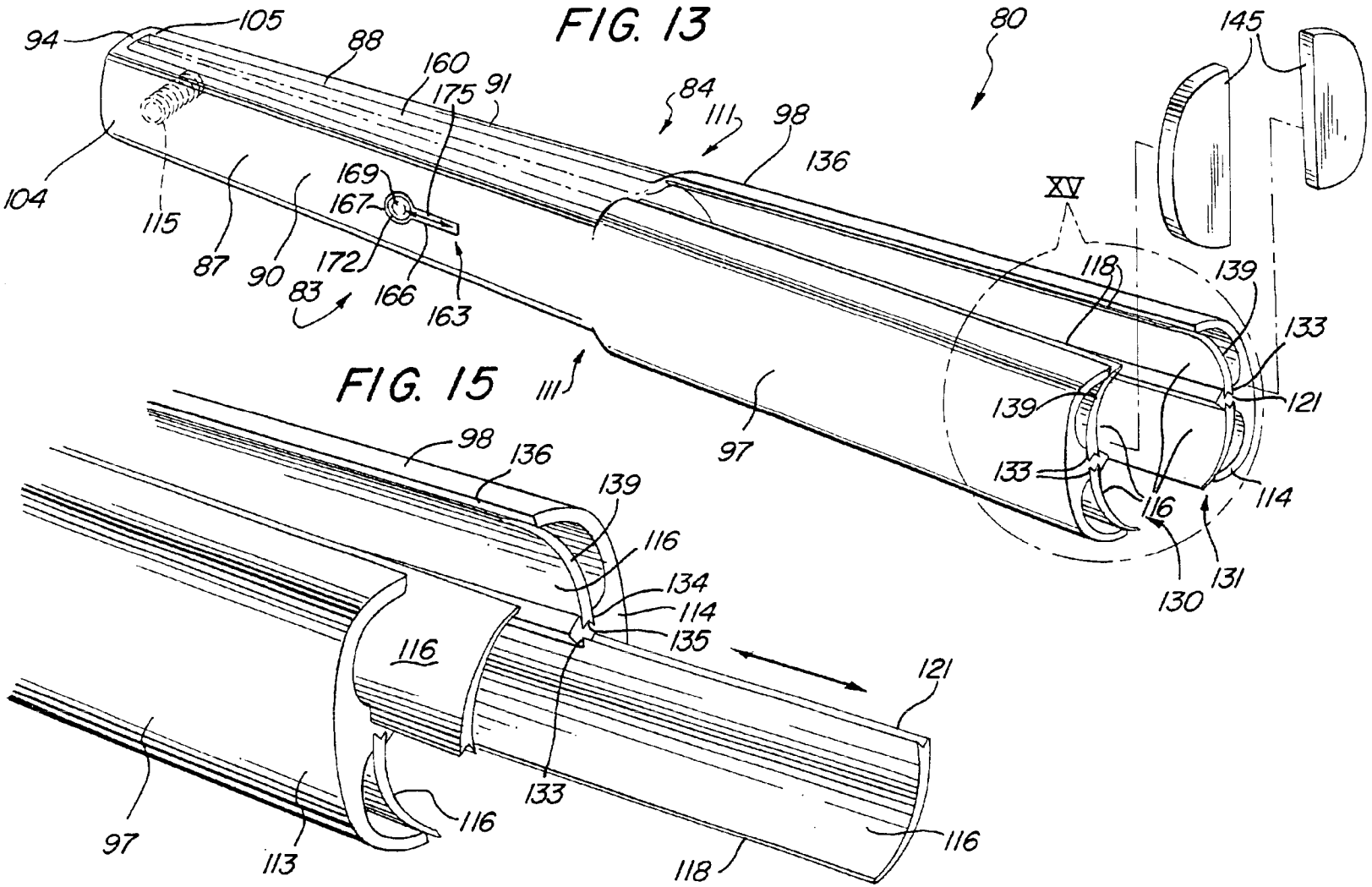
FIG. 13 is a perspective view of the fourth alternative embodiment of the invention.
FIG. 15 is a detailed perspective view of section XV of FIG. 13 depicting installation or removal of the tools with respect to the instrument.

The first and second members 83, 84 preferably have a spring 115 between the first and second members 83, 84 near the proximal ends 104, 105 as shown in FIG. 13. This spring 115 can be a compression spring similar to that illustrated in the embodiment of FIG. 8B. However, in the fourth alternative embodiment, the instrument 80 behaves similarly to a pair of tongs in which the members 83, 84 are biased outwardly away from each other. Thus, the bias of the spring 115 must be opposed in order to move the members 83, 84 of the instrument 80 to the fully closed position.

FIG. 13 is a perspective view showing the instrument 80 with a pair of blades 116. As shown, the blades 116 have unsupported edges 118 and supported edges 121. The unsupported edges 118 have cutting edges or portions 124 for severing hairs 32. The supported edges 121 have enlarged portions 127 for securely mounting the blades 116 on the legs 97, 98 of the instrument 80.

Analogous to the first through the third embodiments, the legs 97, 98 provide jaws 130, 131 comprising sockets 133 in which the enlarged portions 127 of the supported edges 121 of the blades 116 are securely held. As shown in FIGS. 13 and 15, the enlarged portions 127 may include wedge sectioned grooves 134 receiving triangular sectioned elements 135, which protrude from a base of the sockets 133 and matingly engage in the wedge sectioned grooves 134 of the blades 116.

Figure 14:
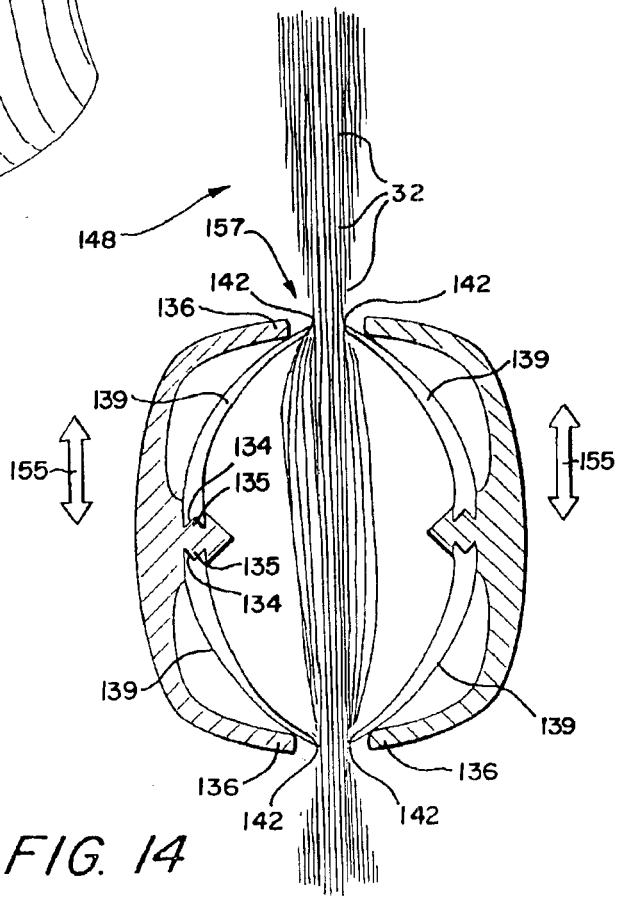
FIG. 14 is a cross section view taken along lines XIV—XIV of FIG. 12 and depicting actual cutting during use of the third alternative embodiment.

As shown in FIGS. 13 and 14, the blades 116 have a continuously curved configuration between the supported edges 121 and unsupported edges 118, which may be incorporated into the blades 116. Alternatively, the blades 116 may be bent during assembly of the blades on the instrument 80. Specifically, the position and orientation of the sockets 133 with respect to inwardly projecting edges 136 of the jaws 130 can act to hold the blades 116 in a curved configuration. In this case, the sockets 133 together with the inwardly projecting edges 136 flex each blade 116 into a continuous curve between the unsupported edge 118 and the supported edge 121 of each blade 116.

Alternatively, and preferably, the blades 116 can be made without the continuous curvature between the unsupported and supported edges 118, 121, in which case they will project substantially in respective planes similar to the tools 28 of the first through the third embodiments described above.

FIGS. 13 and 14 also show the end surfaces 139 of the blades 116. As can be appreciated, the blades 116 are continuously tapered between the unsupported edge 118 and the supported edge 121. This has the advantage of providing and enlarged or larger supported edge 121 for more stable mounting of the blades 116 in the jaws 130, 131. At the same time, the taper reduces the material of the blade 116 toward the unsupported edge 118. Less material nearer the unsupported edge 118 improves flexibility of the blade 116 for facilitating bending of the unsupported edge 118 into the needed orientation of use when such bending is needed. Furthermore, the cutting edge 124 is provided by a bevel 142. When the blades are tapered as shown in FIGS. 13 and 14, less material removal is required to form the bevel 142. Thus, sharpening is also facilitated by the tapered configuration of the blades 116.

FIG. 15 shows the blade 116 either being removed from, or installed into, the instrument 80. As can be appreciated, the step of installing the blades 116 in the instrument 80 can be implemented during the manufacture of an integral combination of the instrument 80 and the blades 116. Such an integral combination might provide a device that could be discarded once the blades 116 have become dull. As such, it is intended that the integral version of instrument 80 and blades 116 can be inexpensively replaced by similar devices as often as desired.

Alternatively, and preferably, the instrument 80 could be adapted for installation of disposable blades 116 thereon. In either case, during installation or removal of the blades 116, caps 145 are removed from the distal ends of the members 83, 84 as shown in FIG. 13. In the embodiment in which replaceable blades are provided, the caps 145 may be made to snap fit into place on the distal ends 113, 114 of the members 83, 84.

As described in the previous embodiments, the method of using the device of FIGS. 12 to 15 is accomplished by placing a lock of hair 148 between the legs 97, 98 of instrument 80. The legs 97, 98 carry blades 116 in the jaws 130, 131 as described above. The unsupported edges 118 of the blades 116 protrude inwardly from the jaws 130, 131 beyond the inwardly projecting edges 136 and meet each other as shown in FIG. 14. The hairs 32 of the lock of hair 148 are caught between the cutting edges 124 during the pinching step. It should be noted that the unsupported edges 118 do not protrude outwardly from an outer surface of the blades 97, 98 in their closed position. This safeguards against accidents whereby a user's hand might otherwise be cut by a protruding blade.

After the steps of placing and pinching, the hairs 32 are severed by moving the instrument in a direction of arrows 151 along the length of the lock of hair 148 while holding the instrument transverse to the length of the lock of hair 148. By guiding the hairs 32 between the jaws 130, 131, while pulling or pushing the instrument in a direction of the arrows 151 along the length of the hairs 32, a tapered cut is achieved as shown in FIGS. 12 and 14. Simultaneously, a greater or lesser pinching force in the direction of arrows 154 can be applied. As in the previous embodiments, the amount of pinching force applied to the grip portions 124, 125 will be selected in accordance with the angle of taper desired. Furthermore, the angles of the unsupported edges 118 of the blades 116 can facilitate the pinching action during movement of the instrument 80 along the hairs 32 as described with regard to the first through the third embodiments above.

A feature of the embodiment of FIGS. 12–15 relates to the method including reciprocating movement of the instrument in opposite directions along the length of the lock of hair 148 as indicated by double headed arrow 155 in FIG. 14. That is, a user can grasp an end of the lock of hair 148 with one hand and sweep the instrument back and forth along the length of the lock of hair. In this way, the hairs 32 are cut with single flat surfaces 56 similar to those shown in FIG. 9B, yet have opposite angles caused by each subsequent sweep. This action and the resulting cut provides a back cut effect and can help the hair 148 stand up.

In the fully closed pinching position shown in FIG. 14, the arms 87, 88 can abut each other and stop further movement of the legs 97, 98 toward each other. In this case, the arms 87, 88 extend inwardly to a position indicated by dashed lines 156 in FIG. 13. With the arms 87, 88 abutting each other, a gap 157 is provided between the jaws 130, 131. The blades 116 lie within the gap 157 and also abut each other along the unsupported edges 118 in the fully closed position. The gap 157 allows the hairs 32 to pass between the jaws 130, 131 unimpeded by the jaws 130, 131 even when the jaws 130, 131 are in the fully closed position. The hairs 32 are thus only impeded by the forces applied to them by the blades 116 during cutting of the hairs 32.

Alternatively, the arms 87, 88 can also define a gap 160 therebetween as indicated in FIG. 13. The gap 160 between the arms 87, 88 can be provided by stops 30 that are not shown in FIG. 13, but which may be similar to the stops 30 of FIG. 7B of the previously described embodiments. The gap 160 is for the purpose of preventing stray hairs 32 from being snagged or caught between the arms 87, 88 during the pulling or pushing step. As a further alternative, the gap 160 between the arms 87, 88 and the gap 157 between the legs 97, 98 can depend solely upon the abutment of unsupported edges 118 of the blades 116 and an offset provided by the hinge 94. That is, the device may be configured such that the blades 116 hold the legs 97, 98 and the arms 87, 88 in spaced relation to each other along all but a hinged portion at the proximal ends 104, 105 of the members 83, 84. It is contemplated that the gaps 157 and 160 can be provided by a spacing between respective legs 97, 98 and respective arms 87, 88 in a range of about 0 to ½ inch.

The instrument 80 may also comprise a lock 163 for holding the members 83, 84 together when not in use. To this end, the first member 83 may include a slot 166 having an enlarged end 167 for receiving a pin 169. The pin 169 is movably connected to the second member 84 and has an enlarged head 172 that is received through the enlarged end 167 of the slot 166. The pin 169 can be slid along the slot 166 so that the enlarged head moves in and out of a locking position as indicated by double-headed arrow 175.

Any or all of the teachings of the first through the third embodiments can be applied to the fourth embodiment. Particularly, utilizing any of a variety of the previously described tools in place of one or both of the blades 116 is contemplated.

There may be other embodiments and variations of embodiments that are not set forth here, and which are within the spirit and scope of the instant invention. Furthermore, the instant invention is not to be limited by the description and terms used herein, but is only to be limited in accordance with the claims.

What is claimed is:

1. A haircutting instrument with blades, comprising:

a first member having a proximal end and a distal end, a second member having a proximal end and a distal end, the first member being connected to the second member by a hinge for relative pivoting movement between an open position and a closed pinching position;

each of the first member and second member having a leg comprising a respective one of the distal ends;

the legs forming respective first and second jaws spaced from each other in the closed pinching position;

the jaws further comprising sockets receiving first and second blades;

the first and second blades comprising respective first and second supported edges and respective first and second unsupported edges;

the jaws holding the blades so that the first and second unsupported edges of the respective first and second blades abut each other in the closed pinching position;

each of the first member and the second member having an arm comprising a respective one of the proximal ends of the members;

the arms having gripping portions for engagement by a user's hand;

the arms connected to each other by a hinge at respective proximal ends;

the first arm connected to and supporting the first leg;

the second arm connected to and supporting the second leg; and the arms abutting each other in the closed pinching position.

2. The haircutting instrument and blades of claim 1, wherein the blades are permanently connected to the instrument and instrument and the blades are disposable.

3. The haircutting instrument and blades of claim 1, wherein the blades are removably supported in the sockets and the blades are disposable and replaceable.

4. The haircutting instrument and blades of claim 1, wherein the sockets comprise first and second sockets in respective first and second jaws, the jaws further comprising:

third and fourth sockets in the respective first and second jaws so that each jaw has two sockets; and third and fourth blades received in the third and fourth sockets so that each jaw carries two blades.

5. The haircutting instrument and blades of claim 1, wherein the blades each have:

a cutting portion on a unsupported edge and an enlarged portion on a supported edge; and a continuous taper between the unsupported edge and the supported edge.

6. The haircutting instrument and blades of claim 1, wherein the blades each have:

a cutting portion on a unsupported edge and an enlarged portion on a supported edge; and a continuous arc shape between the unsupported edge and supported edge.

7. The haircutting instrument and blades of claim 1, wherein the blades each have:

a cutting portion on a unsupported edge and an enlarged portion on a supported edge; and the enlarged portion having a triangular shaped section.

8. The haircutting instrument and blades of claim 1, wherein the instrument has a lock comprising interconnecting elements on the respective first and second members for locking the first and second members in a closed position when not in use.

* * * * *